United States Patent [19]

Kranz et al.

[11] 4,260,008

[45] Apr. 7, 1981

[54] SIDE DAM APPARATUS FOR USE IN TWIN-BELT CONTINUOUS CASTING MACHINES

[75] Inventors: Paul J. Kranz, Westfield, N.J.; Lloyd A. Scroggins, Amarillo, Tex.

[73] Assignee: Asarco Incorporated, New York, N.Y.

[21] Appl. No.: 43,920

[22] Filed: May 30, 1979

[51] Int. Cl.[3] ..... B22D 11/06

[52] U.S. Cl. ..... 164/431; 164/6

[58] Field of Search ..... 164/431, 432, 429, 430, 164/87, 6; 75/153

[56] References Cited

U.S. PATENT DOCUMENTS

| | | | |
|---|---|---|---|
| 2,135,254 | 11/1938 | Hensel et al. | 75/153 |
| 2,142,671 | 1/1939 | Hensel et al. | 75/153 |
| 2,167,684 | 8/1939 | Sawyer | 75/159 |
| 2,212,254 | 8/1940 | Stott | 75/153 |
| 2,640,235 | 6/1953 | Hazelett | 164/432 X |
| 2,904,860 | 9/1959 | Hazelett | 164/432 X |
| 2,978,761 | 4/1961 | Foye et al. | 164/431 |
| 3,036,348 | 5/1962 | Hazelett et al. | 164/432 |
| 3,123,874 | 3/1964 | Hazelett et al. | 164/432 X |
| 3,142,873 | 8/1964 | Hazelett et al. | 164/432 |
| 3,167,830 | 2/1965 | Hazelett et al. | 164/432 X |
| 3,860,057 | 1/1975 | Garlick | 164/432 X |
| 3,864,973 | 2/1975 | Petry | 164/432 X |
| 3,878,883 | 4/1975 | Hazelett et al. | 164/432 |
| 3,921,697 | 11/1975 | Petry | 164/432 X |
| 3,937,270 | 2/1976 | Hazelett et al. | 164/432 X |
| 3,937,274 | 2/1976 | Dompas | 164/432 X |
| 3,949,805 | 4/1976 | Hazelett et al. | 164/432 |
| 3,955,615 | 5/1976 | Dompas et al. | 164/432 X |
| 4,002,197 | 1/1977 | Hazelett et al. | 164/432 X |

OTHER PUBLICATIONS

*Beryllium-Copper Casting Ingots and Master Alloys*, Bulletin 3, Brush Beryllium, Cleveland, Ohio, Sep. 1957, 75–153.

"Application Data Sheet–Copper, Brass, Bronze", Copper Development Association, Inc., New York, 1975, p. 4.

*Primary Examiner*—Robert D. Baldwin
*Assistant Examiner*—J. Reed Batten, Jr.
*Attorney, Agent or Firm*—Kenneth A. Koch

[57] ABSTRACT

Casting side dam apparatus for use in a twin-belt continuous casting machine. The side dams each comprise a multiplicity of slotted dam blocks strung on a flexible metal band. The dam blocks are each formed of a beryllium-copper alloy and are resistant to intergranular cracking and chipping over a prolonged discontinuous, cumulative period of thermal cycling between temperatures ranging between about 800° F. and about 300° F.

19 Claims, 9 Drawing Figures

SIDE DAM APPARATUS FOR USE IN TWIN-BELT CONTINUOUS CASTING MACHINES

BACKGROUND OF THE INVENTION

1. Field of the Invention

This invention relates to improved casting side dam apparatus and more particularly to improved casting side dam apparatus especially adapted for use in twin-belt continuous casting machines, the improved casting machine equipped with such casting side dam apparatus, and improved dam-blocks for the casting side dam apparatus.

2. Description of the Prior Art

Twin-belt casting machines for continuously casting molten metal are known in the prior art, and are referred to as the Hazelett casting machine. A pair of spaced-apart endless flexible casting belts traveling along above and below a mold region define the upper and lower surfaces of a moving mold in such casting machines. The two side surfaces of the moving mold are defined by a pair of spaced-apart, endless flexible side dams which travel along between the casting belts. Each of the side dams are formed by a multiplicity of slotted blocks strung onto a flexible metal strap. Such an apparatus is disclosed in U.S. Pat. No. 3,955,615, with the dam blocks of such casting machine being made of Bronze Corson alloy which has a reported composition of 1.5 to 2.5% nickel, 0.4 to 0.9% silicon, 0.1 to 0.3% iron, 0.1 to 0.5% chromium, balance copper. Use of the casting machine having the Bronze Corson alloy dam blocks forming the side dams for casting copper resulted in the problems arising of the dam blocks prematurely undergoing intergranular cracking and chipping after only a short period of use equivalent to about 1500 tons of copper cast. The intergranular cracking was attributed to the thermal cycling between temperatures of about 300° F. and about 800° F. to which the dam blocks are subjected to in the operation of the casting machine. The prior art dam blocks of the Bronze Corson also failed to retain conductivity above 35% IACS and hardness above 90 Rockwell B after the short period of use equivalent to about 1500 tons of copper cast.

Twin-belt continuous casting machines are also disclosed in U.S. Pat. Nos. 2,904,860; 3,036,348; 3,949,805; 3,937,274; 3,937,270; 3,921,697; 4,002,197; 3,123,874; 3,878,883; 3,167,830; 3,142,873 and 3,864,973.

The following beryllium-copper alloys are in the alloy prior art and obtainable in commerce. They have previously been given by the Copper Development Association, acting on behalf of the Unified Numbering System, the alloy numbers hereafter set forth: Copper Alloy No. C17500: 2.4%–2.7% Co, 0.4%–0.7% Be, 0.10% maximum Fe, total of Be plus Co plus Cu being 99.5% minimum; Copper Alloy No. C17600: 1.4–1.7% Co, 0.25–0.50% Be, 0.9–1.1% Ag, 0.10% maximum Fe, total of Be plus Co plus Ag plus Cu being 99.5% minimum; Copper Alloy No. C17700: 2.4–2.7% Co, 0.40–0.7% Be, 0.40–0.6% Te, 0.10% Fe maximum, total of Be plus Co plus Te plus Cu being 99.5% minimum; Copper Alloy No. C17000: 1.60–1.79% Be, total of Be plus Cu being 99.5% minimum; Copper Alloy No. C17200: 1.80–2.00% Be, total of Be plus Cu being 99.5% minimum; and Copper Alloy No. C17300: 1.80–2.00% Be, 0.20–0.6% Pb, total of Be plus Pb plus Cu being 99.5% minimum.

OBJECTS OF THE INVENTION

One object of this invention is to provide new and improved side dam apparatus for use in twin-belt continuous casting machines, the side dam apparatus having new and improved dam blocks making up the casting side dams.

Another object is to provide new and improved dam blocks for the casting side dams of twin-belt continuous casting machines.

A further object is to provide new and improved dam blocks for casting side dams of twin-belt continuous casting machines, the dam blocks characterized by being resistant to intergranular cracking and chipping over a prolonged period of exposure to thermal cycling at temperatures ranging between about 800° F. and about 300° F.

A further object is to provide new and improved dam blocks for casting side dams of twin-belt continuous casting machines, the dam blocks retaining their hardness in excess of 90 Rockwell B and their conductivity in excess of 35% IACS over a prolonged period of thermal cycling between temperatures as high as about 800° F. and as low as about 300° F.

Still another object is to provide an improvement in Hazelett twin-belt continuous casting machines, the improvement residing in the casting side dam apparatus of the casting machine and specifically in the dam blocks thereof.

Additional objects and advantages will be readily apparent as the invention is hereinafter described in more detail.

SUMMARY OF THE INVENTION

Side dam apparatus for use in a twin-belt continuous casting machine of the type wherein two spaced-apart side dams each revolve in a loop traveling along a casting zone from the input end to the output end of the casting zone and between a pair of revolving spaced-apart casting belts thereby defining a moving mold. The side dams return from the output end to the input end of the casting zone along a return path located away from the casting zone. The side dams each comprise a plurality of, ordinarily a multiplicity of, dam blocks removably secured to a flexible continuous securing means. In accordance with the present invention, the dam blocks are each formed of a copper base alloy comprising beryllium, cobalt and copper. The alloy herein is characterized by a hardness in excess of 90 Rockwell B and conductivity in excess of 35% IACS. By virtue of the dam blocks being formed of the beryllium and cobalt-containing copper base alloy, it was found that the blocks were resistant to intergranular cracking, chipping and impact deformation over a prolonged period of exposure to thermal cycling at temperatures between about 300° F. and about 800° F. The blocks also retained hardness in excess of 90 Rockwell B, and conductivity in excess of 35% IACS over a prolonged period of exposure to thermal cycling at temperatures ranging from about 800° F. to about 300° F. These were unexpected results and results which were a considerable improvement over the use of the aforementioned Bronze Corson alloy dam blocks which prematurely underwent intergranular cracking and chipping and had a too limited life.

By the term "thermal cycling" as used herein is meant the repeated subjection of the dam blocks to alternately high temperatures up to about 800° F. and lower temperatures ranging down to about 300° F. during the operation of the Hazelett twin-belt continuous casting machine for casting copper. IACS as used herein means the International Annealed Copper Standard.

In the dam block herein, in its broader aspects, the beryllium is present in the alloy of the block in an effective amount in excess of a trace amount but not more than 0.7%, and the cobalt in amount greater than the beryllium content but not more than 2.7%. The total of beryllium plus cobalt plus copper is 99.5% minimum of the alloy. Percentages herein are by weight of the alloy unless otherwise specified.

The dam block alloy herein usually comprises, by weight, beryllium in amount within the range of 0.25% to 0.7%, cobalt in amount within the range of 1.4% to 2.7%, and 0 to 0.1% iron. The total of beryllium plus cobalt plus copper is 99.5% minimum.

The preferred dam block alloy herein comprises, by weight, 0.4% to 0.7% beryllium, 2.4% to 2.7% cobalt, 0 to 0.1% iron, balance substantially all copper, the total of beryllium plus cobalt plus copper being 99.5% minimum.

Another alloy utilizable herein for forming the dam blocks comprises all the constituents and in the proportion ranges set forth immediately above and, as an additional constituent, tellurium in amount within the range of 0.4% to 0.6% by weight of the alloy. The total of cobalt plus beryllium plus tellurium plus copper is 99.5% minimum.

A further alloy utilizable herein contains silver as an additional constituent and comprises, by weight, 0.25% to 0.5% beryllium, 1.4% to 1.7% cobalt, 0.9% to 1.1% silver, 0 to 0.1% iron, balance substantially all copper. The total of cobalt plus beryllium plus silver plus copper is 99.5% minimum.

The dam block of this invention, which comprises the block of alloy comprising beryllium, copper and cobalt in the proportions previously disclosed herein, is characterized by the alloy exhibiting a hardness in excess of 90 Rockwell B and a conductivity in excess of 35% IACS. The block is resistant to intergranular cracking and chipping over a prolonged period of exposure to thermal cycling at temperatures between about 300° F. and 800° F. The block is equipped with a securing means for securing the block to a flexible securing means, which is ordinarily a continuous flexible means, such as a flexible metallic strap, or other suitable flexible securing means.

The dam block herein has a slot extending through the length of the block, which functions as a means for securing the block to the flexible securing means, for instance the flexible metallic strap.

The slot is ordinarily generally T-shaped in cross section, the slot being adjacent one face of the block. The blocks are strung onto the strap in forming a casting side dam by inserting the strap into and through the slots of the blocks prior to securing together, ordinarily by welding, the opposite end portions of the strap to form a continuous loop. The blocks are slideable on the strap.

Those faces, at least, of the dam block herein which contact the spaced-apart casting belts, the immediately adjacent dam blocks, and the molten metal being cast are ordinarily, except for the slot extending through the end faces and the bottom face of the block, smooth or substantially smooth, planar surfaces. The side face of the dam block opposite the side face which contacts the molten metal is ordinarily also a smooth or substantially smooth, planar surface. The last-mentioned side face of the dam block can be the side face which contacts the molten metal upon reversal of the dam block, so that the former downstream end face of the block becomes the upstream end face of the block in the casting side dam.

The alloys herein are ordinarily wrought alloys. The alloys are obtainable in commerce, for instance from Brush Wellman Corporation of Cleveland, Ohio. The properties of the alloys herein of hardness in excess of 90 Rockwell B and conductivity in excess of 35% IACS are of the alloy in the heat treated, precipitated condition. The alloys herein are obtainable from the producer in the heat treated, precipitated condition. It is reported that this property of the alloys of hardness in excess of 90 Rockwell B is the property after precipitation heat treating of the alloy at 900° F.

The dam blocks of the present invention did not undergo intergranular cracking after a prolonged period of use in side dam apparatus of the Hazelett twin-belt continuous metal casting machine during which the dam blocks were subjected to thermal cycling ranging from temperatures as high as about 800° F. to temperatures of about 300° F., and specifically after a prolonged discontinuous cumulative use period corresponding to in excess of 20,000 tons of copper cast employing the Hazelett casting machine to feed a rolling mill in the copper rod line. The blocks also retained hardness in excess of 90 Rockwell B and conductivity in excess of 35% IACS over the prolonged period. The dam blocks of this invention also retained their original machined geometry over the prolonged period of use in spite of being subjected to appreciable abrasive and rubbing forces and the thermal cycling during operation of the twin-belt continuous casting machine. The faces of such dam blocks remained smooth and planar, and the edges of such dam blocks remained sharp and well defined during operation of such twin-belt casting machine with the result a tight, leak-proof, moving mold cavity was maintained for the molten copper being cast. The retention of the original machined geometry or shape of the blocks, after the prolonged use of the dam blocks in the Hazelett twin-belt casting machine during which the blocks were subjected to the abrasive and rubbing forces and thermal cycling as set forth previously herein, were also unexpected results.

BRIEF DESCRIPTION OF THE DRAWINGS

FIG. 3 is an end elevational view of a dam block;

DETAILED DESCRIPTION OF THE DRAWINGS

Figure 1:
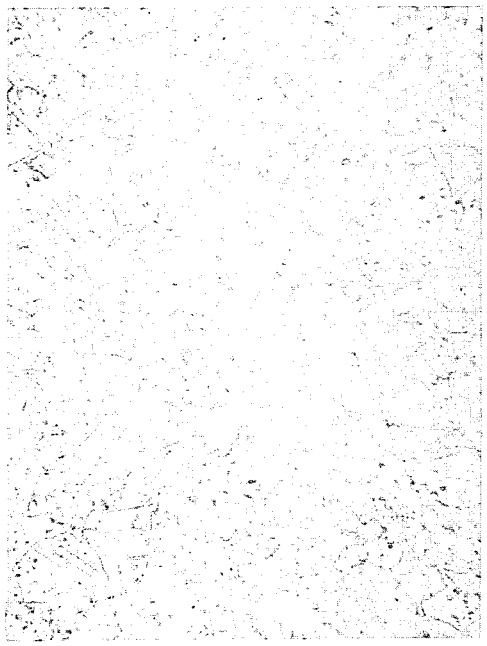
FIG. 1 is a photomicrograph of an alloy of the dam block of the present invention after use for a period equivalent to 1500 tons of copper cast and at 400X magnification.
Figure 2:
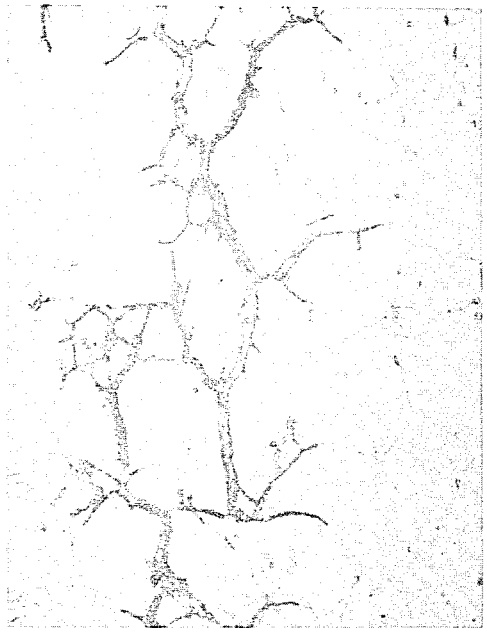
FIG. 2 PRIOR ART
FIG. 2 is a photomicrograph of the prior art Bronze Corson dam block after use for a period equivalent to 1500 tons of copper cast and at 400X magnification.

Referring to FIGS. 1 and 2, the alloy of the dam block of this invention shown in FIG. 1 was free of intergranular cracking after a period of use in a side dam of the Hazelett twin-belt continuous casting machine equivalent to 1500 short tons of copper cast. On the contrary the Bronze Corson of the prior art dam block shown in FIG. 2 underwent extensive intergranular cracking after a period of use in a side dam of the Hazelett twin-belt continuous casting machine equivalent to 1500 short tons of copper cast. Both specimens of FIGS. 1 and 2 were polished by a standard metallographic preparation procedure and thereafter etched with $NH_4OH$ plus $H_2O_2$ prior to the photomicrograph. The capability of the alloy of the invention dam block to withstand intergranular cracking despite the thermal cycling of the casting side dam at temperatures ranging from a high of about 800° F. to a low of about 300° F. as well as being subjected to certain abrasion forces is of considerable importance in that the casting side dam is only as good as its weakest dam block. One cracked dam block can result in the requirement to shut down for a lengthy period the casting machine and the entire copper rod line of which it is a part of, to unstring the defective dam block from the band and replace the block, or to replace the entire side dam. Such a shut down of the line with the attendant lost production of rod can be a costly event.

Figure 4:
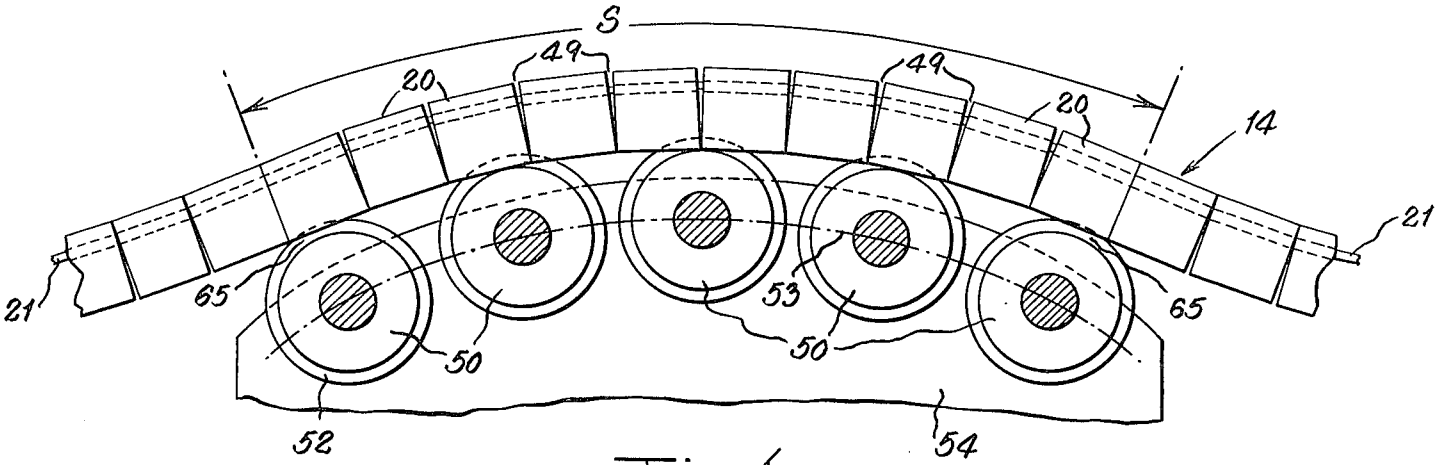
FIG. 4 is an enlargement of a portion of FIG. 5 showing a plurality of dam blocks of a portion of one of the casting side dams, and an arcuate tensioning roller apparatus for tightening the dam blocks.
Figures 5, 7:
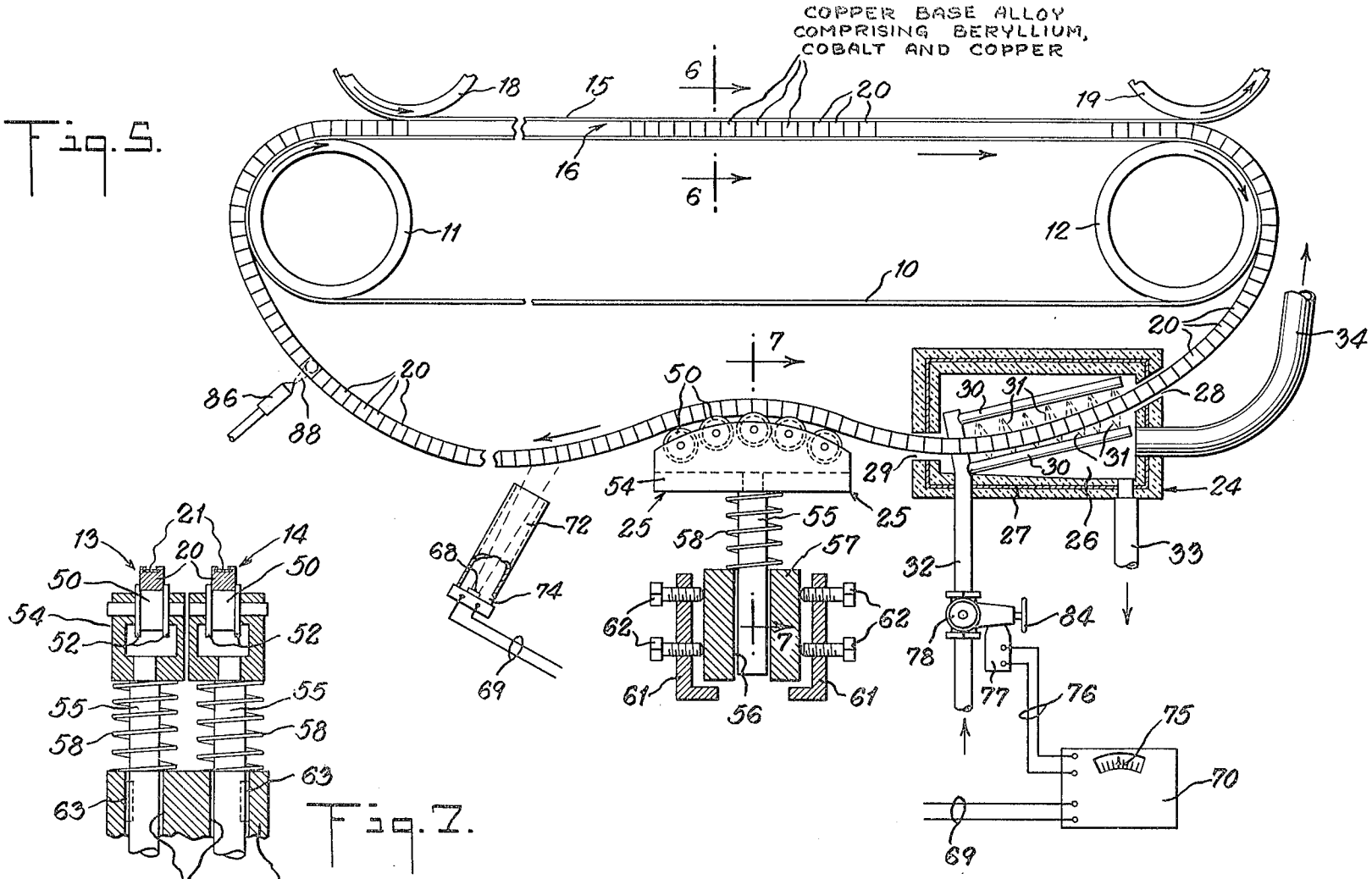
FIG. 5 is a side elevational view of the casting zone, the lower casting belt, a portion of the upper casting belt, and one of the casting side dams in a twin-belt continuous casting machine.

With reference to FIGS. 4 and 5, a Hazelett twin-belt continuous casting machine has lower casting belt 10 which is revolved around rolls 11 and 12. Roll 11 is located at the input end of the machine and roll 12 at the output end of the machine. A moving casting mold is defined by and between lower casting belt 10 cooperating with a pair of spaced casting side dams 13 and 14, shown in FIG. 6, and with upper casting belt 15 as they are conducted together along casting zone 16. Upper casting belt 15 revolves around rolls 18 and 19 which are partially shown in FIG. 5. As casting belts 10 and 15 are revolved, the two side dams 13 and 14 revolve with the belts and pass through casting zone 16, after which dams 13 and 14 return from the output end to the input end of the casting machine along a path which is located away from the casting zone, as shown in FIG. 5. The casting zone 16 is shown horizontal in FIG. 5 for convenience of illustration. However, in operation for casting metal such as copper, the output end of the machine is positioned lower than the input end.

Figure 6:
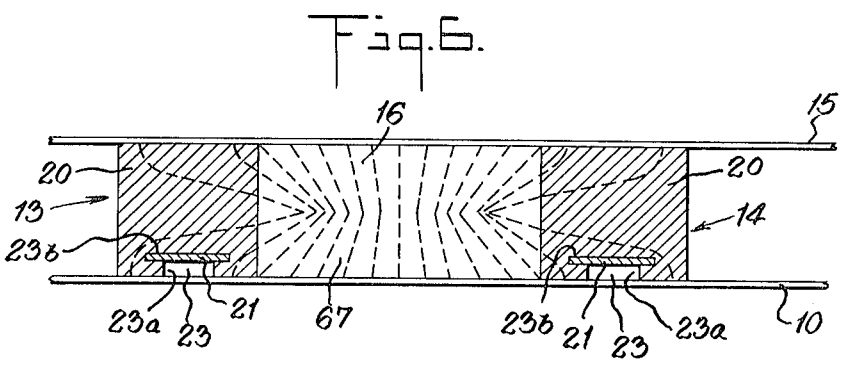
FIG. 6 is an enlarged cross-sectional view taken along plane 6—6 of the casting zone of FIG. 5.

Side dams 13 and 14 each comprise a multiplicity of slotted dam blocks 20, shown also in FIGS. 3 and 6 strung on flexible endless metal strap 21, preferably of stainless steel. The dam blocks 20 each are made of the wrought copper base alloy comprising beryllium, cobalt and copper in accordance with the present invention. Blocks 20 each have parallel or substantially parallel side faces, front and back end faces, and top and bottom faces, and blocks 20 each have a generally T-shaped slot 23 shown in FIGS. 3, 6 and 9, extending completely through the length of the block adjacent the bottom face thereof. Each T-shaped slot 23 has a vertical or substantially vertical slot portion **23*a* and a horizontal or substantially horizontal portion 23*b* of slightly greater width than that of metal strap 21. The vertical slot portion 23*a* communicates the exterior of block 20 with the horizontal slot portion 23*b*. The flexible endless metal strap 21 is disposed in horizontal slot portion 23*b* as shown in FIG. 6**.

Water spray cooling apparatus 24, shown in FIG. 5, is disposed intermediate the output end of the casting machine and tension roller apparatus 25. Cooling apparatus 24, the purpose of which is to cool the side dams, has cooling chamber 26 surrounded by metal box 27 and has entrance and exit openings 28 and 29 for passage of the two side dams through the chamber. A plurality of spray manifolds 30 are disposed within chamber 26, spray manifolds 30 having orifices for projecting multiple liquid sprays 31 onto the individual dam blocks 20. A pipeline 32 supplies the cooling liquid, preferably water, under pressure to the manifolds 30, and a drain pipe 33 drains the liquid from chamber 26. An exhaust duct 34 removes the vapor, e.g. steam, which is generated when the sprays 31 impinge upon the hot side dams. The side dams are cooled by spray cooling apparatus 24 to a temperature which is sufficiently elevated and above the boiling point of water to dry the water off the dam blocks prior to their re-entry into the input end of the machine, but not hot enough to harm a coating which may be applied to the dam blocks. The dam blocks are cooled down to below 535° F. but above the boiling point of water, the preferred range being about 300° F. to about 390° F.

The high heat conductivity and the capability of retaining the high heat conductivity despite being subjected to thermal cycling at temperatures about 800° F. to about 300° F., possessed by the dam blocks made of the alloy comprising beryllium, cobalt and copper in accordance with this invention, are important characteristics of the dam blocks inasmuch as an important function of the dam blocks is to rapidly conduct heat away from the two side surfaces of the cast product 67.

Figure 8:
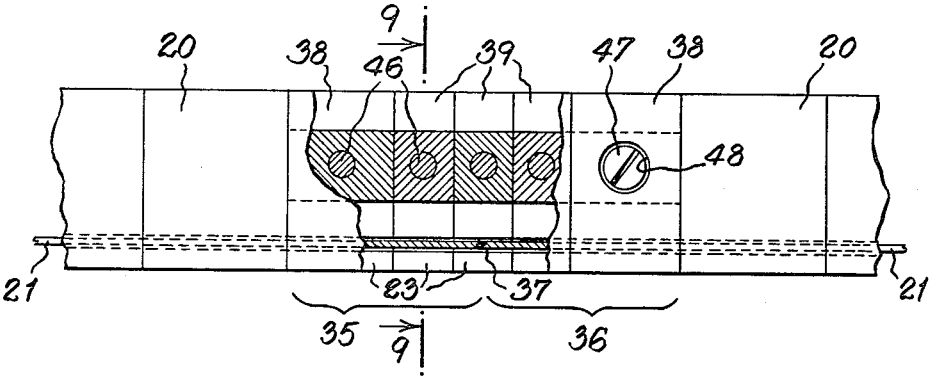
FIG. 8 is an enlarged cross-sectional view of a portion of a side dam showing the special dam blocks which are secured together after the ends of the strap have been welded together.

Side dams 13 and 14 are each constructed by sliding slotted dam blocks 20 onto strap 21. A predetermined small portion 35 and 36 of each end of the strap 21, shown in FIG. 8, for example about 50 millimeters of each end, remain exposed. The two exposed strap ends are welded together at a joint 37 which is smoothed by grinding to form an endless strap loop of accurately predetermined length. The yet uncovered portion of the strap loop 21 is covered by applying a plurality of special dam blocks 38 and 39 each formed by securing two mating interlocking complementary half blocks 40 and 41, shown in FIG. 9, together with a machine screw. The dam blocks 20 had a height and width of 1 15/16 inches. The height of the dam blocks is ordinarily equal to the height of the cast product, as shown in FIG. 6. When thicker or thinner cast product is the desired product, in this event side dams having other sizes of dam blocks are used. The two special blocks 38 and 39 are of the same cross-section as blocks 20. A plurality of narrower special blocks 39 may be inserted as required to complete filling up the available space on the endless strap 21.

Figure 9:
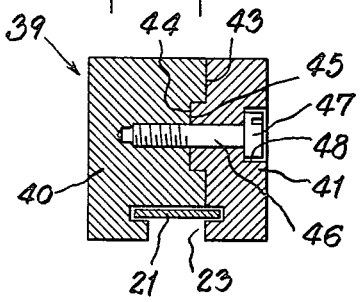
FIG. 9 is a cross-sectional view taken along the plane 9—9 in FIG. 8 showing the construction of the two mating interlocking half blocks on a strap.

Interlocking "half" blocks 40 and 41, shown in FIG. 9, are joined along longitudinal vertical joint 43, extending perpendicular to the plane of strap 21. Blocks 40 and 41 are made of the wrought copper base alloy comprising beryllium, cobalt and copper in accordance with the present invention. Joint 43 is offset from the center of the composite dam block to be positioned as far away as possible from the hot face, i.e. away from the face toward the casting zone. Channel or keyway 44 extends longitudinally of the joint surface of one block 40 intermediate the slot for strap 21 and the top surface of the block, and longitudinal ridge or key 45 on the other block 41 mates into this keyway. Screw 46 passes horizontally through the key 45 and threads into a socket in one half block, while its head 47 seats in recess 48 located on the side of the other half block away from the cast product, i.e. away from the hot face.

In order to force the dam blocks 20 of both side dams 13 and 14 to be tight together in end-to-end abutting relationship along the casting zone, the curved tension roller apparatus 25, shown in FIG. 5, is provided. Apparatus 25 is located intermediate the cooling apparatus 24 and the input end of the casting zone and serves as deflecting means to deflect the traveling side dams along a smoothly curved path section S, shown also in FIG. 4, which is convex in a direction toward the interior of the loop traveled by the side dams. This path section S has sufficient convexity to force wedge-shaped spaces 49, shown in FIG. 4, to occur between adjacent dam blocks along the convex curve above the tension apparatus 25. The endless strap loop 21 permits all of the dam blocks to slide on it. Thus, any available slack among all of the dam blocks is accumulated by the spaces 49 along the curve.

Also, the strap 21 is positioned toward the interior of the side dam loop with respect to the longitudinal centerline of each block. Accordingly, the strap loop is near the widest part of the wedge-shaped spaces 49, and so a relatively short convex inward curve S effectively cumulatively absorbs the available slack space along the remainder of the entire side dam loop forcing blocks tightly together along the casting zone. The rectangular bar product 67 is thereby cast without burrs. The resulting product is advantageous for use in subsequent rolling to form quality copper rod.

Figure 7:
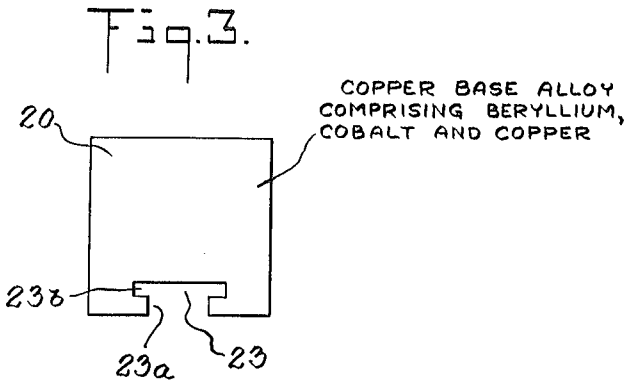
FIG. 7 is an enlarged cross-sectional view taken along the plane 7—7 in FIG. 5 showing the tension roller apparatus which maintains the dam blocks firmly pressed one against the other in the casting zone.

Side tension apparatus 25, shown in FIG. 5, includes a plurality of rollers 50 engaging each of the side dams 13 and 14, with means for individually guiding the dams. This guiding means may, for example, be flanges 52 on the rollers. Rollers 50 are mounted at spaced positions along curve 53, shown in FIG. 4, which extends convex upwards on member 54 having support pedestal 55 which is free to slide up and down in bore 56 in base 57. Springs 58 surrounding pedestals 55 urge the mounting member 54 upwardly. Base 57 is adjustably secured is framework 61 in the machine by set screws 62. Raising the base 57 applies greater upward spring force on the rollers 50 for adjusting the tension apparatus 25 to press the dam blocks more tightly together along the casting zone 16. Keying means 63, shown in FIG. 7, may be provided to prevent pedestals 55 from turning in bores 56 while permitting the pedestals to slide freely up and down.

The leading and trailing ends of the curve 53 may be curved along a shorter radius than the central portion of this curve, as shown in FIG. 4, to accommodate substantial yet smooth curvature of the side dams while traveling over tension apparatus 25. Thus, a space 65 may often exist between the traveling side dams and the leading and trailing roller 50.

The relatively cool dam blocks 20 also serve as heat sinks to help provide a rapid cooling quenching of the cast product as well as functioning to conduct heat into the casting belts. In order to control the temperature of these side dams, temperature sensing means 68, shown in FIG. 5, are provided connected by electrical leads 69 to temperature control 70. Temperature sensing means 68 are shown as being radiation responsive and being spaced away from the respective side dams 13 and 14. Such temperature sensing means are provided for each side dam 13 and 14 for individually controlling their temperatures. Cylindrical protector and shield 72 protects the infra red radiation responsive sensor 68 which is aimed upwardly at the respective side dam loop which is traveling toward the machine input. Cylindrical shield 72 may be tilted slightly away from vertical as shown to prevent dirt particles from dropping directly onto the sensor 68. In case any dirt enters the tubular shield 72, it may be cleaned through port 74.

Controller 70 may include gage 75 to indicate the dam block temperature which is maintained above 212° F. but below 536° F. Circuit means 76 connects the controller 70 to actuator 77 for controlling valve 78 which regulates the amount of cooling spray 31 being applied to the respective side dams 13 and 14. Thus, the side dams are cooled to the desired temperature as they approach the input end of the machine. It is understood that there may be separate pipelines 32 and manifolds 30 for cooling each side dam, and a separate actuator 77 and valve 78 individually controls the temperature of each side dam 13 and 14. A manual actuator 84 may be provided so that valve 78 can be controlled by hand, if desired.

Casting belts 10 and 15 may be coated with a carbonaceous material coating, and the inner faces of the dam blocks, i.e. their faces toward the casting zone 16, may be liquid-spray coated with thermally insulative material, for example, finely divided carbon suspended in a quick-drying liquid vehicle, e.g. trichloroethane by means of spray nozzle 86.

Dam blocks 20 are above 212° F. but below 536° F. when they issue from the cooling chamber 26. Thus, they are dry of all liquid coolant, e.g. water, before they arrive in position for the spray coating 88. Moreover, fast drying of the dam blocks at their controlled temperature permits the liquid-spray coating 88 to dry out and form a dry carbon-containing coating on the inner faces of both side dams 13 and 14 before the side dams reenter the input end of the casting zone.

The Hazelett twin-belt casting machine, which is improved upon by the new and improved casting side dams herein having the new and improved dam blocks and new and improved special dam blocks herein, is obtainable from the Hazelett Strip-Casting Corporation of Winooski, Vermont.

Operation of the Hazelett twin-belt casting machine equipped with the new and improved casting side dams having the new and improved dam blocks of this invention made of the copper base alloy containing beryllium, cobalt and copper, achieved excellent results in continuously casting a copper bar over a prolonged period equivalent to in excess of 20,000 tons of copper cast, without the necessity of any time-consuming, costly shut down to replace cracked or chipped dam blocks. This continuously cast copper bar was well suited for rolling into rod and was supplied from the Hazelett twin-belt casting machine to a rolling mill wherein it was shaped into rod.

DESCRIPTION OF THE PREFERRED EMBODIMENTS

Preferably the alloy of the dam block herein comprises, by weight, 2.4% to 2.7% cobalt, 0.4% to 0.7% beryllium, 0 and 0.1% iron, balance substantially all copper. The total of cobalt plus beryllium plus copper is 99.5% minimum.

Tests were carried out on the Hazelett twin-belt continuous casting machine with dam blocks made of an extruded beryllium-copper alloy also containing cobalt in accordance with the present invention; and with dam blocks supplied with the twin-belt casting machine, which blocks were made of Bronze Corson, an extruded silicon bronze alloy containing additions of chromium, iron and nickel. The alloys had the following compositions by chemical analysis, percentages being by weight. The beryllium-copper alloy contained 96.77 Cu, 0.55 Be, 2.38 Co; and the Bronze Corson contained 97.02 Cu, 0.73 Si, 1.73 Ni, 0.36 Cr and 0.083 Fe.

Several of the beryllium-copper alloy dam blocks wherein the alloy also contained cobalt were substituted for some of the Bronze Corson dam blocks on the same stainless steel strap in a casting side dam of the twin-belt casting machine, and the machine thereafter operated to continuously cast a copper bar.

The Bronze Corson dam blocks showed intergranular cracking and a reduction in conductivity to below 35% IACS after only 1500 tons of copper bar had been cast.

The dam blocks of beryllium-copper alloy also containing cobalt showed no intergranular cracking after more than 20,000 tons of copper bar had been cast over a prolonged, discontinuous, cumulative period. The conductivity of such alloy of the blocks was still greater than 35% IACS after such prolonged period of casting equivalent to in excess of 20,000 tons.

What is claimed is:

1. Side dam apparatus adapted for use in a twin-belt continuous casting machine wherein two spaced-apart side dams each revolve in a loop and travel along a casting zone from its input end to its output end between a pair of revolving spaced-apart casting belts thereby defining a moving mold, the side dams returning from the output end to the input end of the casting zone along a return path located away from the casting zone, the side dams each comprising a multiplicity of dam blocks secured to a flexible continuous securing means, the dam blocks each being formed of a copper base alloy comprising beryllium, cobalt and copper, the alloy characterized by being a wrought alloy having a hardness in excess of 90 Rockwell B and a conductivity in excess of 35% IACS, the blocks being resistant to intergranular cracking and chipping over a prolonged period of exposure to thermal cycling at temperatures ranging from about 300° F. to about 800° F., said alloy comprising by weight, beryllium in amount in excess of a trace but not more than 0.7% of the alloy, and the cobalt in amount greater than the beryllium but not more than 2.7% of the alloy, the total of cobalt plus beryllium plus copper being 99.5% minimum.

2. The apparatus of claim 1 wherein the alloy comprises, by weight, 2.4% to 2.7% cobalt, 0.4% to 0.7% beryllium, 0 to 0.1% iron, balance substantially all copper, the total of cobalt plus beryllium plus copper being 99.5% minimum.

3. The apparatus of claim 1 wherein the alloy contains as an additional constituent 0.4% to 0.6% tellurium, the total of cobalt plus beryllium plus tellurium plus copper being 99.5% minimum.

4. The apparatus of claim 1 wherein the alloy contains silver as an additional constituent, the alloy comprising, by weight, 0.25%–0.5% beryllium, 1.4%–1.7% cobalt, 0.9%–1.1% silver, 0 to 0.1% iron, balance substantially all copper, the total of cobalt plus beryllium plus silver plus copper being 99.5% minimum.

5. The side dam apparatus of claim 1 wherein the alloy comprises, by weight, 0.25% to 0.7% beryllium, 1.4% to 2.7% cobalt, and 0 to 0.1% iron, the total of cobalt plus beryllium plus copper being 99.5% minimum.

6. A dam block for use in a twin-belt continuous casting machine comprising a block of a copper base alloy comprising beryllium, cobalt and copper, the alloy characterized by being a wrought alloy having a hardness in excess of 90 Rockwell B and a conductivity in excess of 35% IACS, the block being resistant to intergranular cracking and chipping over a prolonged period of exposure to thermal cycling at temperatures between about 300° F. and about 800° F., and means for securing the block to a flexible securing means, said alloy comprising, by weight, beryllium in amount in excess of a trace but not more than 0.7% of the alloy, and the cobalt in amount greater than the beryllium but not more than 2.7% of the alloy, the total of beryllium plus cobalt plus copper being 99.5% minimum.

7. The dam block of claim 6 wherein the alloy comprises, by weight, 2.4% to 2.7% cobalt, 0.4% to 0.7% beryllium, 0 to 0.1% iron, balance substantially all copper, the total of cobalt plus beryllium plus copper being 99.5% minimum.

8. The dam block of claim 6 wherein the alloy contains as an additional constituent, 0.4% to 0.6% tellurium, the total of beryllium plus cobalt plus tellurium plus copper being 99.5% minimum.

9. The dam block of claim 6 wherein the alloy contains silver as an additional constituent, the alloy comprising, by weight, 0.25%–0.5% beryllium, 1.4%–1.7% cobalt, 0.9%–1.1% silver, 0 to 0.1% iron, balance substantially all copper, the total of beryllium plus cobalt plus silver plus copper being 99.5% minimum.

10. The dam block of claim 6 wherein the alloy comprises, by weight, 0.25% to 0.7% beryllium, 1.4 to 2.7% cobalt, and 0 to 0.1% iron, the total of cobalt plus beryllium plus copper being 99.5% minimum.

11. Method for reducing the incidence of intergranular cracking and chipping of dam blocks subject to prolonged periods of exposure to thermal cycling at temperatures ranging from about 300° F. to about 800° F., said dam blocks adapted for use in a twin-belt continuous casting machine wherein two spaced-apart side dams each revolve in a loop and travel along a casting zone from its input end to its output end between a pair of revolving spaced-apart casting belts thereby defining a moving mold, the side dams returning from the output end to the input end of the casting zone along a return path located away from the casting zone, the side dams each comprising a multiplicity of said dam blocks secured to a flexible continuous securing means, said method including fabricating said dam blocks from a copper base alloy comprising beryllium, cobalt and copper, the alloy characterized by being a wrought alloy having a hardness in excess of 90 Rockwell B and a conductivity in excess of 35% IACS, said alloy comprising by weight, beryllium in amount in excess of a trace but not more than 0.7% of the alloy, and the cobalt in amount greater than the beryllium but not more than 2.7% of the alloy, the total of cobalt plus beryllium plus copper being 99.5% minimum.

12. The method of claim 11 wherein said alloy comprises, by weight, 0.25% to 0.7% beryllium, 1.4% to 2.7% cobalt, and 0 to 0.1% iron, the total of cobalt plus beryllium plus copper being 99.5% minimum.

13. The method of claim 11 wherein the alloy contains as an additional constituent 0.4% to 0.6% tellurium, the total of cobalt plus beryllium plus tellurium plus copper being 99.5% minimum.

14. The method of claim 11 wherein the alloy contains silver as an additional constituent, the alloy comprising, by weight, 0.25%–0.5% beryllium, 1.4%–1.7% cobalt, 0.9%–1.1% silver, 0 to 0.1% iron, balance substantially all copper, the total of cobalt plus beryllium plus silver plus copper being 99.5% minimum.

15. A method for reducing the incidence of intergranular cracking and chipping of a dam block for use in a twin-belt continuous casting machine subject to prolonged periods of exposure to thermal cycling at temperatures ranging from about 300° F. to about 800° F., said method including fabricating said dam block from a copper base alloy comprising beryllium, cobalt and copper, the alloy characterized by being a wrought alloy having a hardness in excess of 90 Rockwell B and a conductivity in excess of 35% IACS, said alloy comprising by weight, beryllium in amount in excess of a trace but not more than 0.7% of the alloy, and the cobalt in amount greater than the beryllium but not more than 2.7% of the alloy, the total of cobalt plus beryllium plus copper being 99.5% minimum.

16. The method of claim 15 wherein the alloy comprises, by weight, 0.25% to 0.7% beryllium, 1.4% to 2.7% cobalt, and 0 to 0.1% iron, the total of beryllium plus cobalt plus copper being 99.5% minimum.

17. The method of claim 15 wherein the alloy comprises, by weight, 2.4% to 2.7% cobalt, 0.4% to 0.7% beryllium, 0 to 0.1% iron, balance substantially all copper, the total of cobalt plus beryllium plus copper being 99.5% minimum.

18. The method of claim 15 wherein the alloy contains as an additional constituent, 0.4% to 0.6% tellurium, the total of beryllium plus cobalt plus tellurium plus copper being 99.5% minimum.

19. The method of claim 15 wherein the alloy contains silver as an additional constituent, the alloy comprising, by weight, 0.25%–0.5% beryllium, 1.4%–1.7% cobalt, 0.9%–1.1% silver, 0 to 0.1% iron, balance substantially all copper, and total of beryllium plus cobalt plus silver plus copper being 99.5% minimum.

* * * * *